US006089926A

United States Patent [19]

Ho et al.

[11] Patent Number: 6,089,926

[45] Date of Patent: Jul. 18, 2000

[54] ELECTRICAL CONNECTOR

[75] Inventors: Yu-Ming Ho, Pen-Chiao; Shun-Chi Tung, Tu-Chen, both of Taiwan

[73] Assignee: Hon Hai Precision Ind. Co., Ltd., Taipei Hsien, Taiwan

[21] Appl. No.: 09/322,702

[22] Filed: May 28, 1999

[30] Foreign Application Priority Data

Dec. 11, 1998 [TW] Taiwan ..... 87220686

[51] Int. Cl.[7] ..... H01R 13/502

[52] U.S. Cl. ..... 439/701

[58] Field of Search ..... 439/701, 631, 439/61; 339/14, 176; 335/133

[56] References Cited

U.S. PATENT DOCUMENTS 3,086,096 4/1963 McGee ..... 335/133

3,482,201 12/1969 Schneck ..... 339/14

3,941,448 3/1976 Evans ..... 339/176

*Primary Examiner*—Gary F. Paumen

*Assistant Examiner*—Phuongchi Nguyen

*Attorney, Agent, or Firm*—Wei Te Chung

[57] ABSTRACT

An electrical connector includes a first insulative housing and a second insulative housing. Each housing has two lugs formed on opposite ends thereof corresponding to each other. Each lug defines a recess having a support face formed therein. Two locking members bridge between the first and second housings and engage with the lugs thereby securing the housings together to form the connector. Each locking member has a base section and two retention sections formed on opposite ends thereof. The retention sections of the locking member are received in the corresponding recesses of the housings. Each retention section has a resilient barb engaging with the corresponding support face. Preferably, each retention section has an inclined edge for facilitating insertion into the corresponding recess.

1 Claim, 4 Drawing Sheets

ELECTRICAL CONNECTOR

BACKGROUND OF THE INVENTION

1. Field of the Invention

The present invention generally relates to an electrical connector, and in particular to an electrical connector having two separate housings secured together by locking members.

2. The Prior Art

An electrical connector having a first insulative housing mounted on a main computer board and a second insulative housing fixed to the first housing for engaging with a computer central processing unit to establish electrical connection between the main board and the central processing unit is well known in the electronics field. A disadvantage of such an electrical connector is that the housings may be detached from each other and form a gap therebetween during removal or replacement of the central processing unit which adversely affects signal transmission.

It is thus desirable to have an electrical connector having locking members which effectively secure a first insulative housing and a second insulative housing of the connector together.

SUMMARY OF THE INVENTION

Accordingly, an object of the present invention is to provide an electrical connector comprising two insulative housings securely and effectively retained together by locking members.

Another object of the present invention is to provide a locking device for effectively securing two insulative housings of an electrical connector together.

To achieve the above objects, an electrical connector in accordance with the present invention comprises a first insulative housing and a second insulative housing. Each insulative housing has two lugs formed on opposite ends thereof corresponding to each other. Each lug defines a recess having a support face formed therein. Two locking members bridge between the first and second housings and engage with the lugs thereby securing the housings together to form the connector. Each locking member has a base section and two retention sections formed on opposite ends thereof. The retention sections of the locking member are received in the corresponding recesses of the housings. Each retention section has a resilient barb engaging with the corresponding support face. Preferably, each retention section has an inclined edge for facilitating insertion into the corresponding recess.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figures 1, 1A:
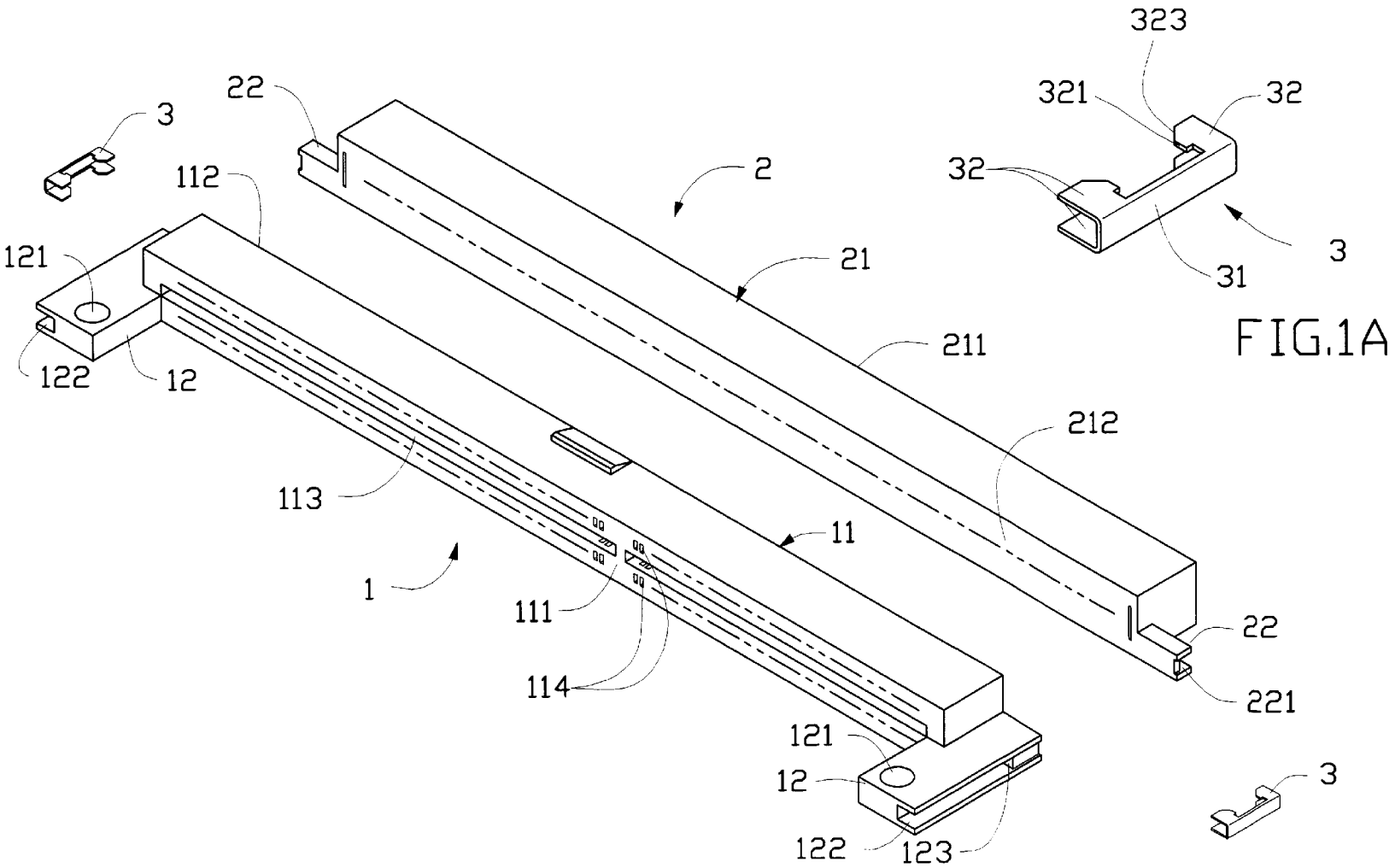
FIG. 1 is an exploded view of an electrical connector constructed in accordance with the present invention.
FIG. 1A is an enlarged view of a locking member of the electrical connector of the present invention.
Figure 2:
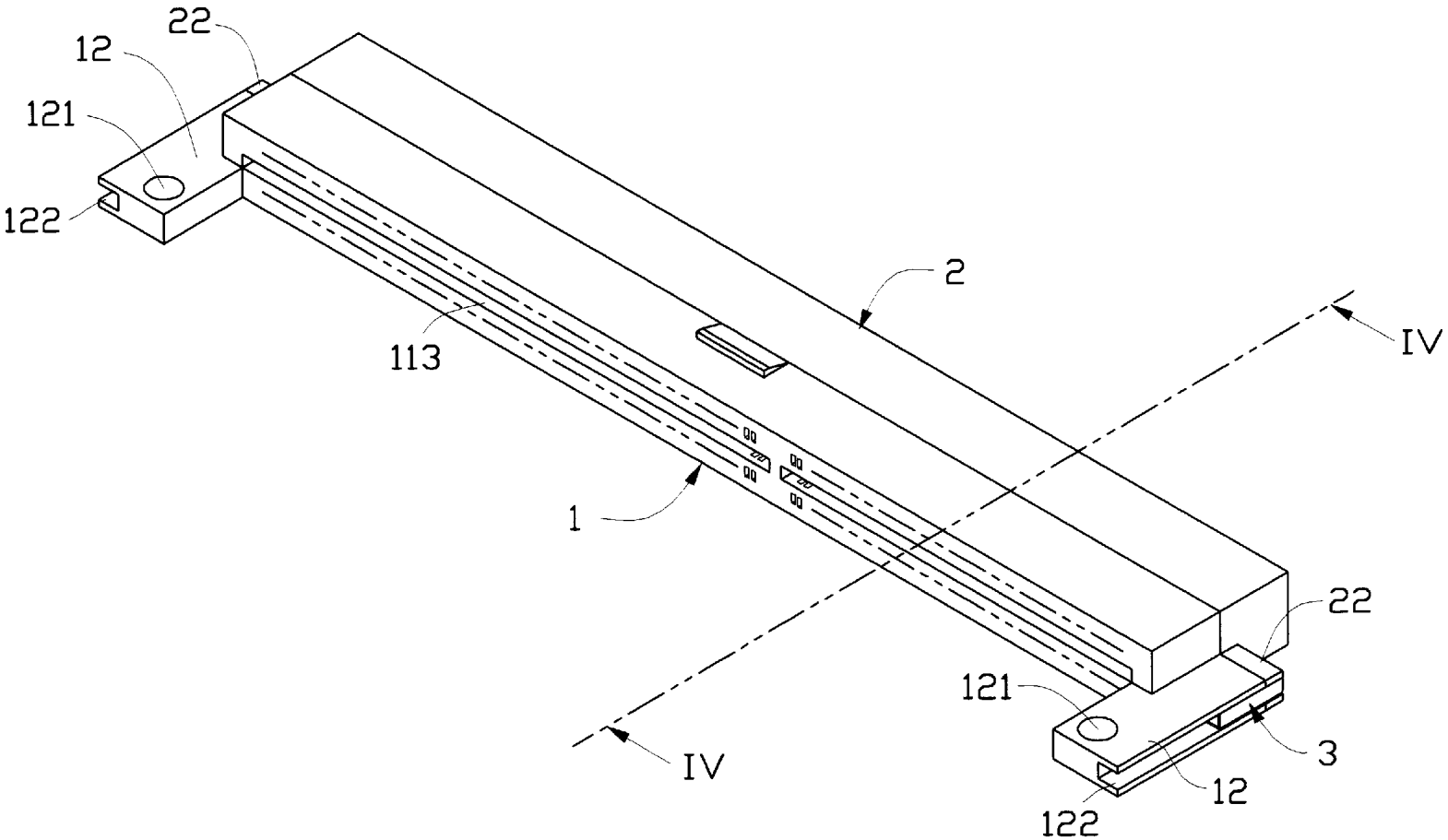
FIG. 2 is an assembled view of FIG. 1.

Referring to the drawings and in particular to FIGS. 1 and 2, an electrical connector constructed in accordance with the present invention comprises a first housing 1 and a second housing 2 secured together by means of two locking members 3.

Figure 4:
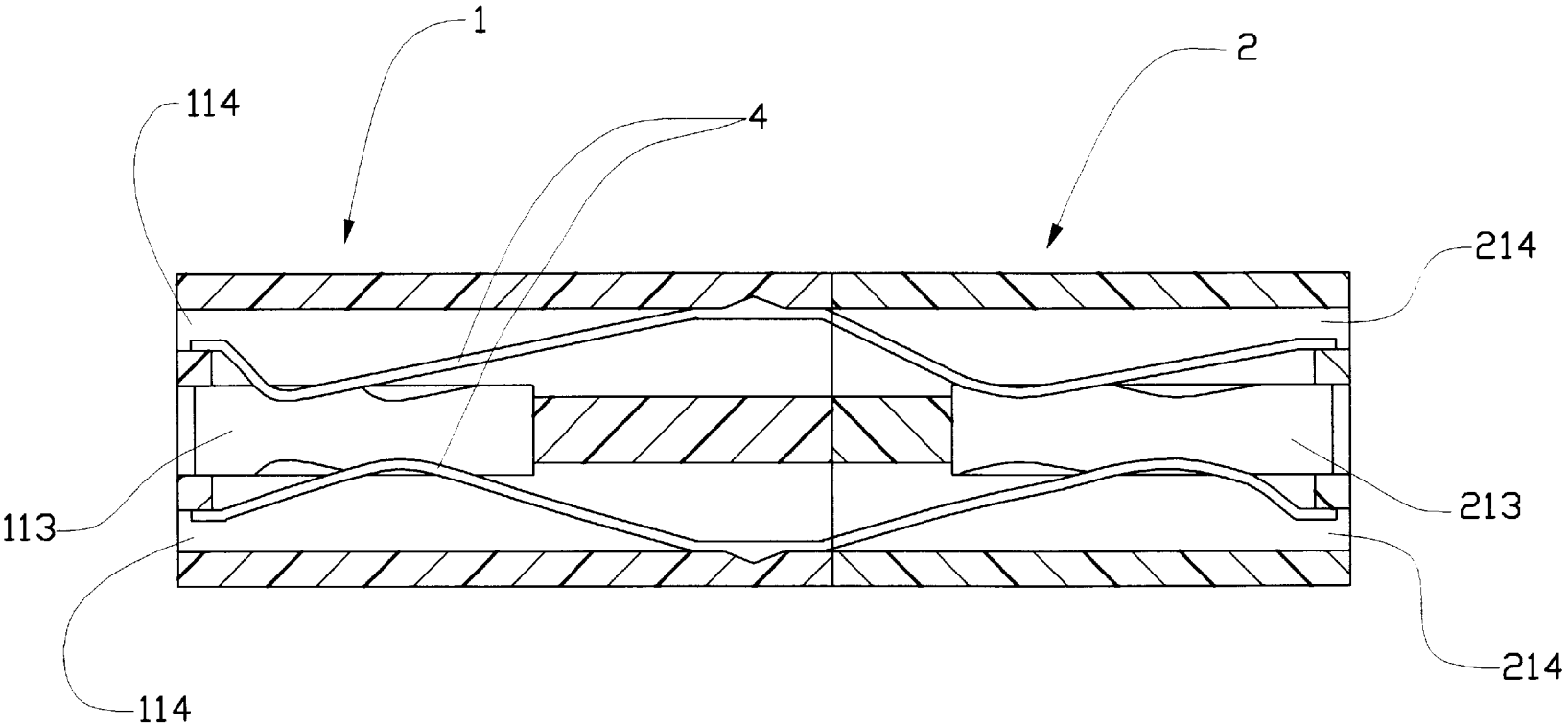
FIG. 4 is a cross-sectional view taken along line IV—IV of FIG. 2.

The first housing 1 comprises an insulative body 11 having a front face 111 and an opposite rear face 112. A slot 113 is defined in the first insulative body 11 between the front face 111 and the rear face 112 for receiving a printed circuit board (not shown). A plurality of passageways 114 is defined in the housing 10 above and below the slot 113 for receiving and retaining contact elements 4 therein (FIG. 4).

The first body 11 has two first lugs 12 formed on opposite ends thereof. Each first lug 12 defines a first recess 122 having a first support face 123 formed therein. Each first lug 12 further defines a bore 121 for receiving a fastener (not shown) to secure the first housing 1 to the circuit board.

Figure 3:
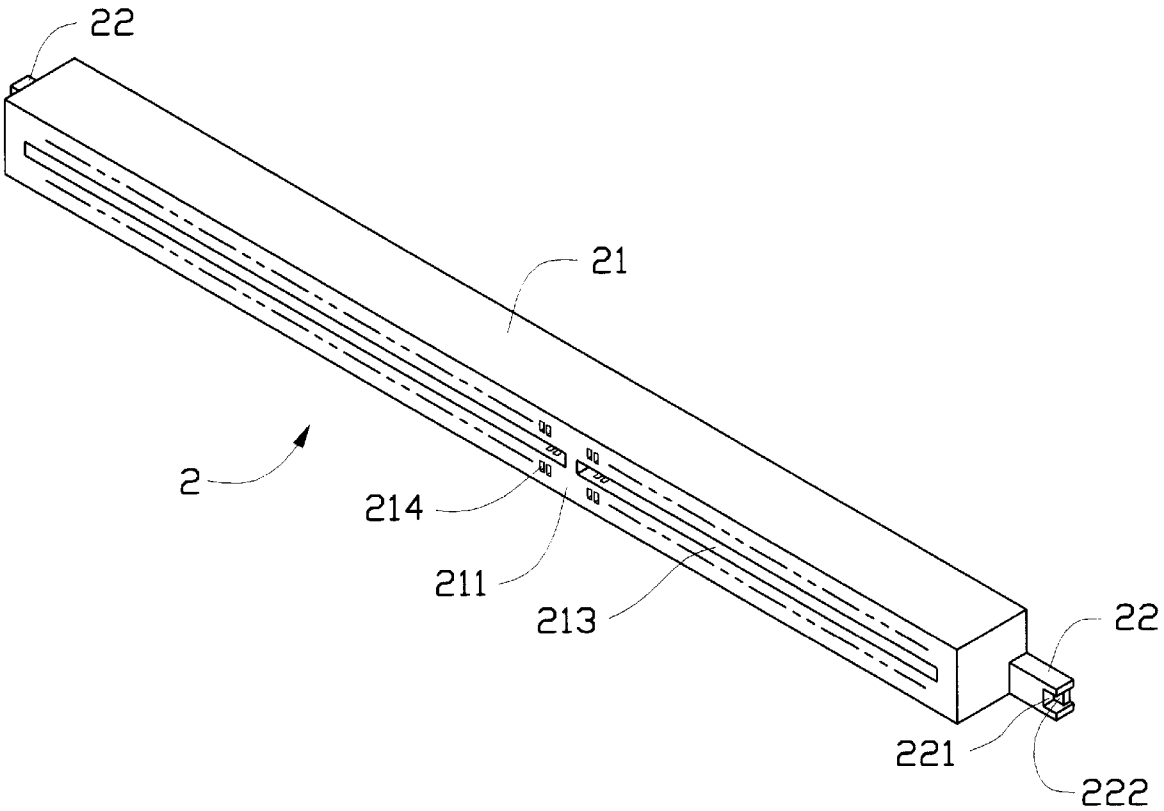
FIG. 3 is a perspective view of a second housing of the electrical connector of the present invention.

Also referring to FIG. 3, the second housing 2 includes a second insulative body 21 having a front face 212 and a rear face 211. The front face 212 abuts against the rear face 112 of the first body 11. A slot 213 is defined in the second body 21 between the front and rear faces 212, 211 for receiving a central processing unit (not shown) or other electronic device. The second body 21 also defines a plurality of second passageways 214 corresponding to and aligned with the first passageways 114 of the first body 11. The contact elements 4 extend through both the first and second passageways 114, 214 as shown in FIG. 4.

The second body 21 has two second lugs 22 formed on opposite ends thereof corresponding to and preferably abutting against the first lugs 12 of the first body 11 when the first and second bodies 11, 21 are engaged with each other. Each second lug 22 defines a second recess 221 having a second support face 222 formed therein.

Referring to FIG. 1A, each locking member 3 has a base section 31 and two retention sections (not labeled) formed on opposite ends thereof. In the embodiment illustrated, the locking member 3 is formed by stamping a metal plate and each retention section comprises two spaced tabs 32 formed by bending.

The retention sections are received in the corresponding recesses 122, 221 of the first and second housings 1, 2 and abut against the first and second support faces 123, 222 thereof thereby securing the first and second housings 1, 2 together. The tabs 32 of the retention sections have resilient barbs 321 engaging with the first and second support faces 123, 222 of the housings 1, 2. Preferably, each tab 32 of the retention sections has an inclined edge 323 for facilitating insertion of the tab 32 into the corresponding recess 122, 221 and the engagement of the barb 321 thereof with the corresponding support face 123, 222.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical connector comprising:

a first insulative body having a first face and an opposite second face, two first lugs being formed on opposite ends of the first body, each first lug defining a first recess having a first support face formed therein;

a second insulative body having a third face and an opposite fourth face, two second lugs being formed on opposite ends of the second body corresponding to the first lugs of the first body, each second lug defining a second recess having a second support face formed therein;

contact elements received in passageways extending through both the first and second bodies and adapted to electrically engage with a first electronic device and a second electronic device respectively connected to the first and second bodies; and two locking members corresponding to the first and second lug pairs, each locking member comprising a base section and two retention sections formed on opposite ends of the base section for being received in the first and second recesses of the first and second lugs and engaging with the first and second support faces thereof thereby securing the first and second bodies together with the third face of the second body abutting against the second face of the first body;

wherein each retention section of each locking member comprises a face engaging portion engaging with the support face of the corresponding recess;

wherein each retention section of each locking member comprises an inclined edge for facilitating insertion into the corresponding recess;

wherein the face engaging portion comprises at least one barb engaging with the support face of the corresponding recess;

wherein the locking members are made by stamping a metal plate whereby each retention section thereof comprises two spaced tabs, each tab having a barb engaging with the support face of the corresponding recess;

wherein each tab comprises an inclined edge for facilitating insertion into the corresponding recess;

wherein each first lug defines a bore therein adapted to receive a fastener for securing the first body to the first electronic device.

* * * * *